US010982464B2

(12) United States Patent
Ying et al.

(10) Patent No.: US 10,982,464 B2
(45) Date of Patent: Apr. 20, 2021

(54) CENTRAL BIDIRECTIONAL ROTATION LOCKING MECHANISM FOR FOLDING TENT

(71) Applicant: ZHEJIANG JIANSHENG LEISURE PRODUCTS CO., LTD, Zhejiang (CN)

(72) Inventors: Qiwang Ying, Zhejiang (CN); Yuanru Sun, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 0 days.

(21) Appl. No.: 16/795,600

(22) Filed: Feb. 20, 2020

(65) Prior Publication Data

US 2020/0181939 A1 Jun. 11, 2020

(30) Foreign Application Priority Data

Dec. 25, 2019 (CN) ..... 201922364040.5

(51) Int. Cl.
*E04H 15/48* (2006.01)

(52) U.S. Cl.
CPC ..... *E04H 15/48* (2013.01)

(58) Field of Classification Search
CPC ..... E04H 15/48; E04H 15/50
See application file for complete search history.

(56) References Cited

U.S. PATENT DOCUMENTS

| | | | | |
|---|---|---|---|---|
| 10,060,153 | B2 * | 8/2018 | Song | E04H 15/50 |
| 10,107,005 | B2 * | 10/2018 | Song | E04H 15/44 |
| 10,273,711 | B2 * | 4/2019 | Song | E04H 15/48 |
| 2005/0097829 | A1 * | 5/2005 | Seo | E04H 15/50 52/79.1 |
| 2018/0103734 | A1 * | 4/2018 | Song | E04H 15/34 |
| 2018/0125184 | A1 * | 5/2018 | Song | E04H 15/50 |
| 2019/0368232 | A1 * | 12/2019 | Sun | E05B 65/00 |

FOREIGN PATENT DOCUMENTS

| | | | | |
|---|---|---|---|---|
| DE | 202020100309 U1 * | 2/2020 | | E04H 15/32 |
| WO | WO-2017028659 A1 * | 2/2017 | | E04H 15/46 |

* cited by examiner

*Primary Examiner* — Noah Chandler Hawk
(74) *Attorney, Agent, or Firm* — JCIP Global Inc.

(57) ABSTRACT

A central bidirectional rotation locking mechanism for a folding tent includes a lock rod, an upper lock plate, and a lower lock plate assembly. The lower lock plate assembly includes a first lower plate, an unlocking plate, and a second lower plate. An elastic locking member and an unlocking mechanism used to control the elastic locking member to perform locking are disposed in the unlocking plate. The elastic locking member is used to lock the lock rod, and the unlocking plate is capable of bidirectional rotation. When the unlocking plate rotates, the unlocking mechanism is enabled to unlock the elastic locking member and the lock rod.

8 Claims, 9 Drawing Sheets

CENTRAL BIDIRECTIONAL ROTATION LOCKING MECHANISM FOR FOLDING TENT

CROSS-REFERENCE TO RELATED APPLICATION

This application claims the priority benefit of China application serial no. 201922364040.5, filed on Dec. 25, 2019. The entirety of the above-mentioned patent application is hereby incorporated by reference herein and made a part of this specification.

BACKGROUND

Technical Field

The present invention belongs to the field of technologies of components of folding tents, and specifically, to a central bidirectional rotation locking mechanism for a folding tent.

Description of Related Art

With the development of the tent industry, folding tents are widely used, and a lock member that controls unfolding and folding of a folding tent has become a main research object for various manufacturers. This component directly affects overall complexity of a product structure and difficulty of unfolding and folding, and also relate to production costs. Although an existing lock member for a folding tent resolves a problem that a traditional lock member has a complex structure and is tedious is operate, an unfolding manner of the traditional lock is relatively limited, especially a rotatably unfolded lock member can only be unfolded in one direction, and is restrictively used.

SUMMARY

In view of the problems existing in the prior art, an objective of a design of the present invention is to provide a central bidirectional rotation locking mechanism for a folding tent. The rotation locking mechanism may implement a bidirectional operation.

The present invention is implemented based on the following technical solutions.

A central bidirectional rotation locking mechanism for a folding tent is provided. The central bidirectional rotation locking mechanism includes a lock rod, an upper lock plate fixedly disposed at an upper end of the lock rod, and a lower lock plate assembly detachably connected to a lower end of the lock rod. The lower lock plate assembly includes a first lower plate, an unlocking plate, and a second lower plate, an elastic locking member and an unlocking mechanism used to control the elastic locking member to perform locking are disposed in the unlocking plate, the elastic locking member is used to lock the lock rod, and the unlocking plate is capable of bidirectional rotation. When the unlocking plate rotates, the unlocking mechanism is enabled to unlock the elastic locking member and the lock rod.

A central hole through which the lock rod extends is correspondingly provided at a central location of the first lower plate and a central location of the unlocking plate, a locking column extending downwards is disposed at a location, corresponding to the central hole, of a lower surface of the first lower plate, and a locking space is provided on the locking column.

The elastic locking member includes an integrally disposed arc-shaped portion and two horizontal locking rods extending inwards from a gap of the arc-shaped portion, a lower end portion of the lock rod is provided with a step used in cooperation with the locking rods, and the step extends downwards to form a clamping and locking portion of an arc-shaped structure.

A connection column is vertically disposed on an edge of the second lower plate, an arc-shaped travel hole that penetrates up and down is provided at a corresponding location on an edge of the unlocking plate, and after the connection column extends through the travel hole, the connection column is fixedly connected to the first lower plate by a fastening member. The setting may ensure rotation of the unlocking plate when the first lower plate and the second lower plate remain still.

The upper lock plate is hingedly connected to a long tent bone, the first lower plate is hingedly connected to a short tent bone, the locking space is two cutting faces that are symmetrically provided on the locking column, two horizontal locking rods are clamped on the two cutting faces, and a distance between the two cutting faces is less than an aperture of the central hole. Based on the setting, the two locking rods may be seen from the top of the central hole.

The unlocking mechanism includes locking blocks that are symmetrically disposed on an inner wall of the unlocking plate, a gap is reserved between each of the locking blocks and the inner wall of the unlocking plate, the gap is used to place a closed end of the arc-shaped portion of the elastic locking member, and two ends of each of the locking rods of the elastic locking member respectively abut on two sides of the corresponding locking block.

A plurality of the connection columns are disposed along the edge of the second lower plate through uniform distribution, and a quantity of the travel holes is the same as a quantity of the connection columns.

A radian of the arc-shaped travel hole is the same as a radian of the unlocking plate. This setting facilitates smooth rotation of the unlocking plate.

A width between two locking rods is not less than a width between the locking blocks.

The present invention has a properly designed structure. The locking mechanism can bidirectionally rotate by disposing a rotation mechanism. In addition, the unlocking plate is disposed, so that the lock rod can be unlocked provided that the unlocking plate is screwed. Operation is more convenient and quicker, and practicability is stronger.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

and

Figure 13:
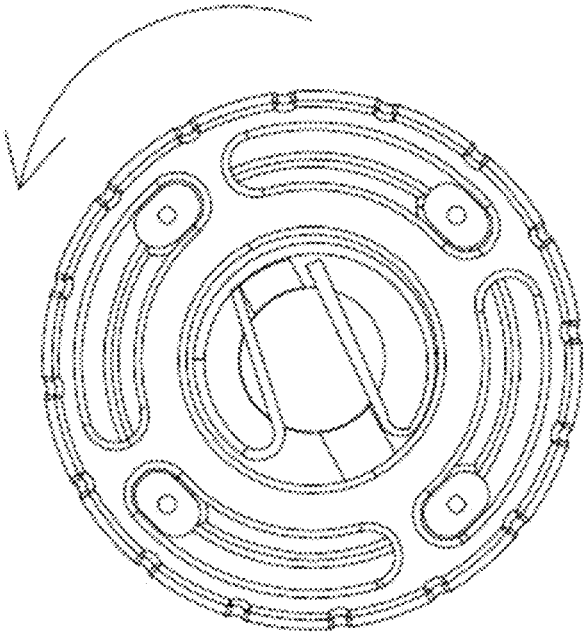

FIG. 13 is a schematic structural diagram of the unlocking plate that anticlockwise rotates.

DESCRIPTION OF THE EMBODIMENTS

The present invention is further described in detail below with reference to the accompanying drawings of the specification, and specific implementations are provided.

The present invention discloses a central bidirectional rotation locking mechanism for a folding tent. The locking mechanism is mainly used to unfold and fold the folding tent. A structure of the locking mechanism is shown in FIG. 1 to FIG. 11, and includes a lock rod 1, an upper lock plate 2 fixedly disposed at an upper end of the lock rod 1, and a lower lock plate assembly 3 detachably connected to a lower end of the lock rod 1. The lower lock plate assembly 3 sequentially includes a first lower plate 31, an unlocking plate 32, and a second lower plate 33 from top to bottom. The upper lock plate 2 is hingedly connected to a long tent bone and the first lower plate 31 is hingedly connected to a short tent bone. An elastic locking member 4 and an unlocking mechanism used to control the elastic locking member 4 perform locking are disposed in the unlocking plate 32. The elastic locking member 4 includes an integrally disposed arc-shaped portion 41 and two horizontal locking rods 42 extending inwards from a gap of the arc-shaped portion 41, a lower end portion of the lock rod 1 is provided with a step 11 used in cooperation with the locking rod 42, and the step 11 forms downwards a clamping and locking portion 12 of an arc-shaped structure.

Preferably, a central hole 5 through which the lock rod 1 extends is correspondingly provided at a central location of the first lower plate 31 and a central location of the unlocking plate 32, a locking column 34 that is of a cylindrical structure and that extends downwards is integrally disposed at a location, corresponding to the central hole 5, of a lower surface of the first lower plate 31, a locking space 35 is provided on the locking column 34, the locking space 35 is two cutting faces that are symmetrically provided on the locking column 34, two horizontal locking rods 42 are clamped on the two cutting faces, and a distance between the two cutting faces is less than an aperture of the central hole 5.

Preferably, a connection column 36 is vertically disposed on an edge of the second lower plate 33, an arc-shaped travel hole 37 that penetrates up and down is provided at a corresponding location on an edge of the unlocking plate 32, and after the connection column 36 extends through the travel hole 37, the connection column 36 is fixedly connected to the first lower plate 31 by a fastening member. A radian of the arc-shaped travel hole 37 is the same as a radian of the unlocking plate 32, thereby facilitating smooth rotation. A plurality of the connection columns 36 are disposed along the edge of the second lower plate 33 through uniform distribution. A quantity of the travel holes 37 is the same as a quantity of the connection columns 36, and is preferably set to 3 to 4.

Preferably, the unlocking mechanism includes locking blocks 38 that are symmetrically disposed on an inner wall of the unlocking plate 32, a gap is reserved between each of the locking blocks 38 and the inner wall of the unlocking plate 32, the gap is used to place a closed end of an arc-shaped portion 41 of the elastic locking member 4, and two ends of each locking rod 42 of the elastic locking member 4 respectively abut on two sides of the corresponding locking block 38. A width between two locking rods 42 is not less than a width between the locking blocks 38.

Figure 1:
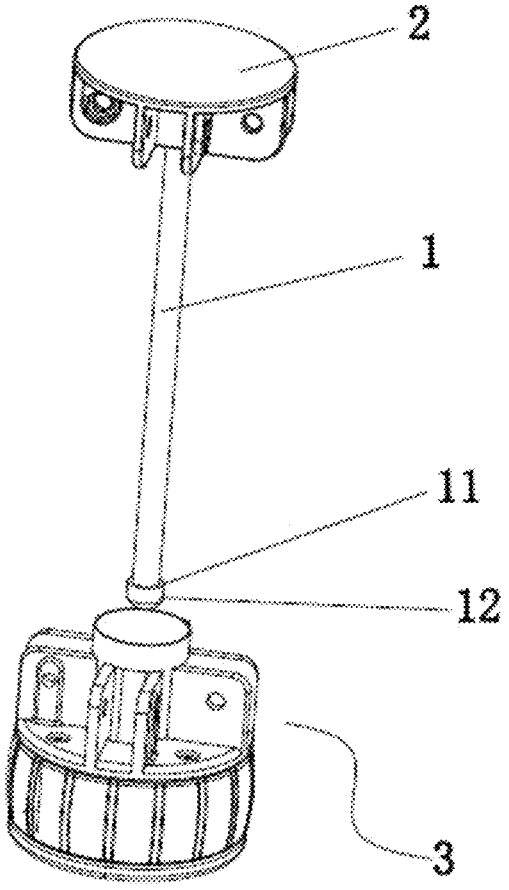
FIG. 1 is a schematic diagram of an entire structure according to the present invention.
Figure 2:
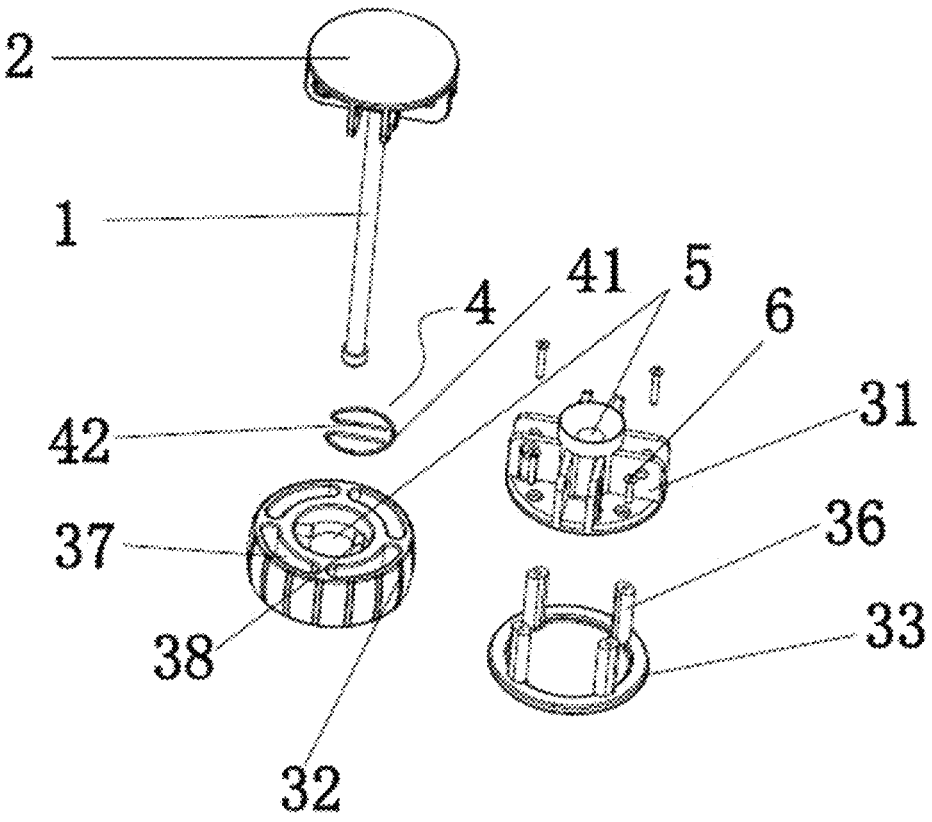
FIG. 2 is an expanded view of the present invention.
Figure 3:
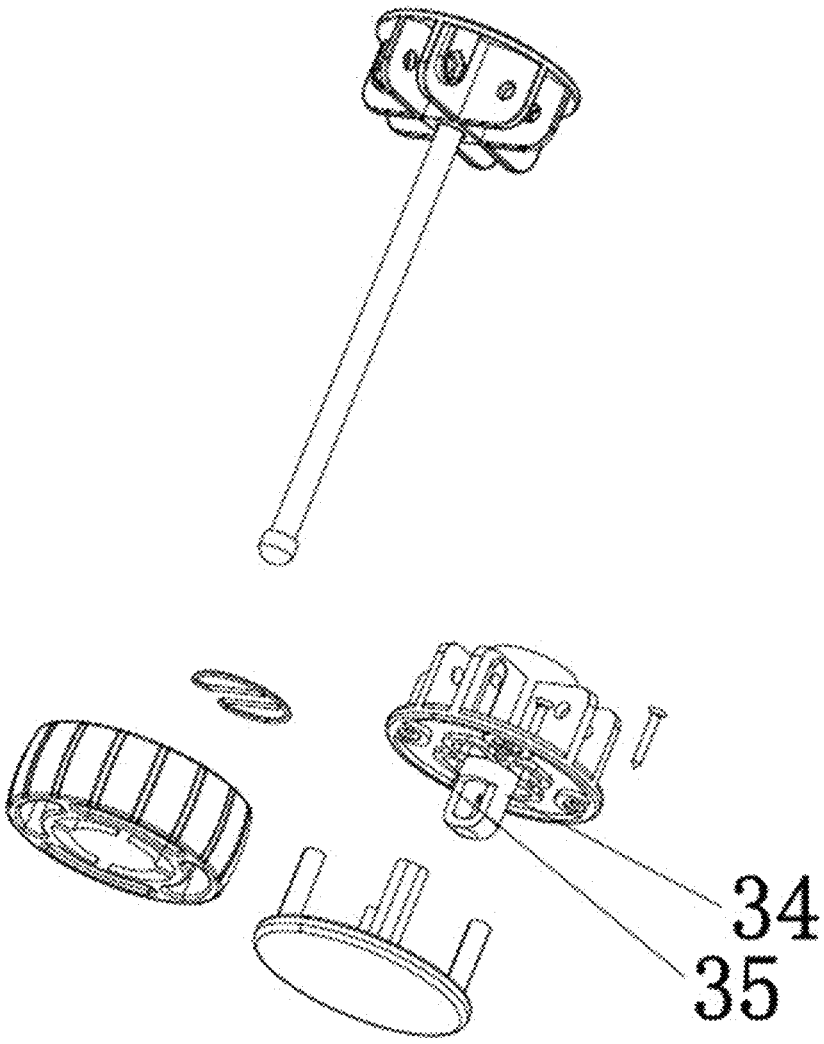
FIG. 3 is an expanded view in another angle according to the present invention.
Figure 4:
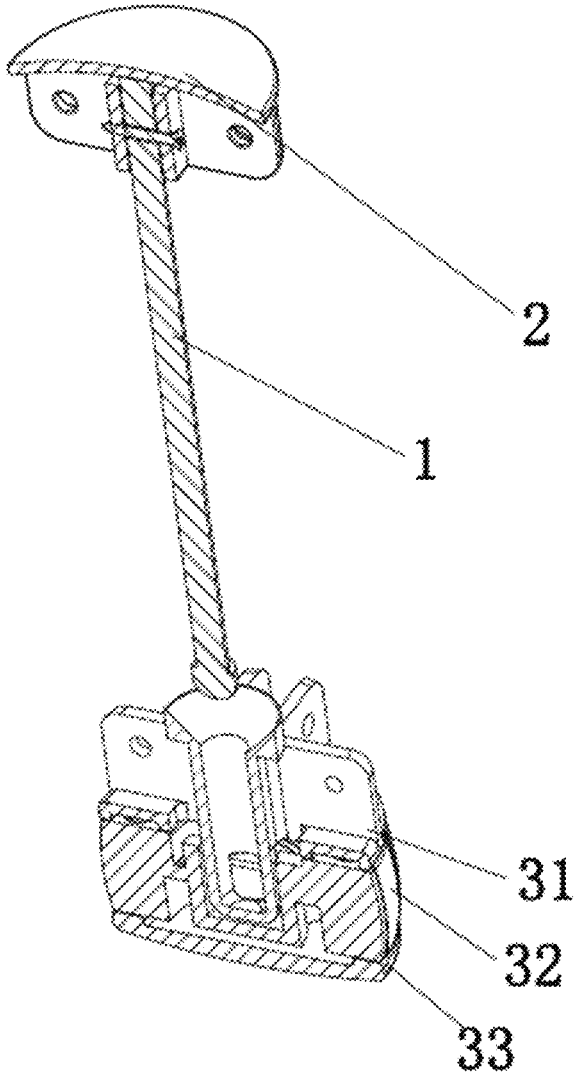
FIG. 4 is a section view of the present invention.
Figure 5:
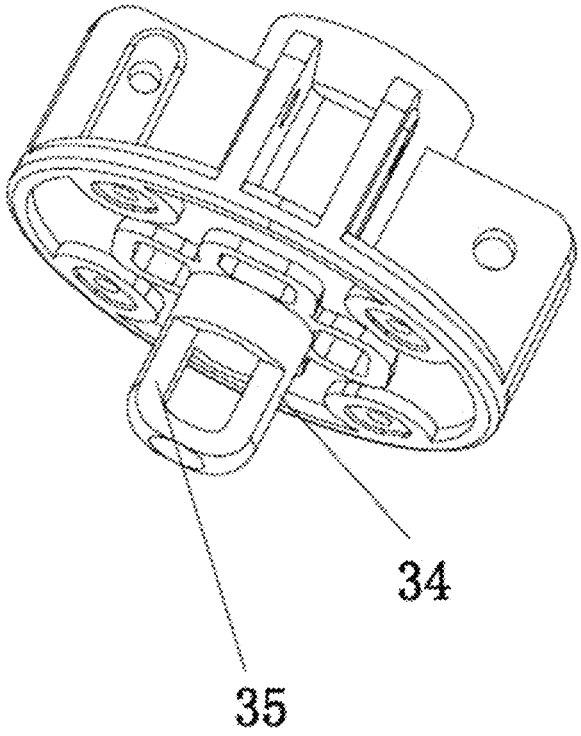
FIG. 5 is a three-dimensional structural diagram of a first lower plate according to the present invention.
Figure 6:
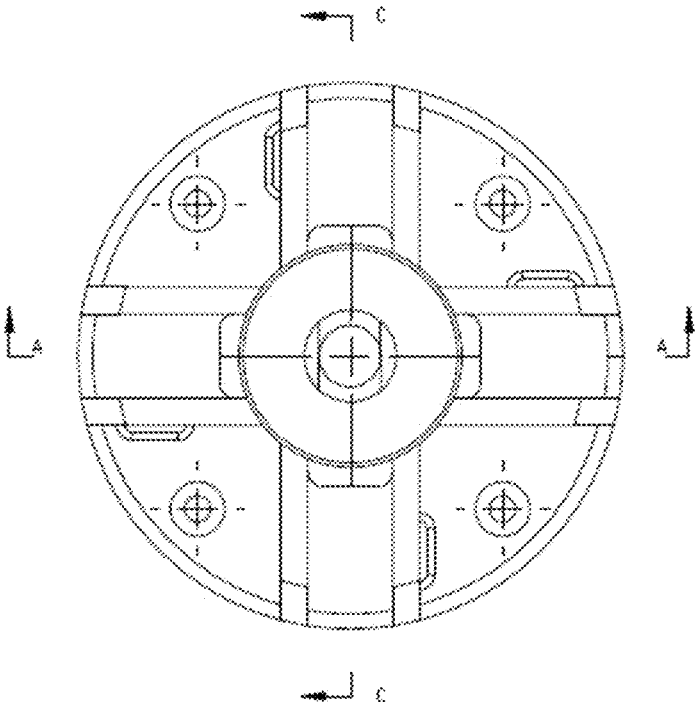
FIG. 6 is a schematic diagram of a top view structure of FIG. 5.
Figure 7:
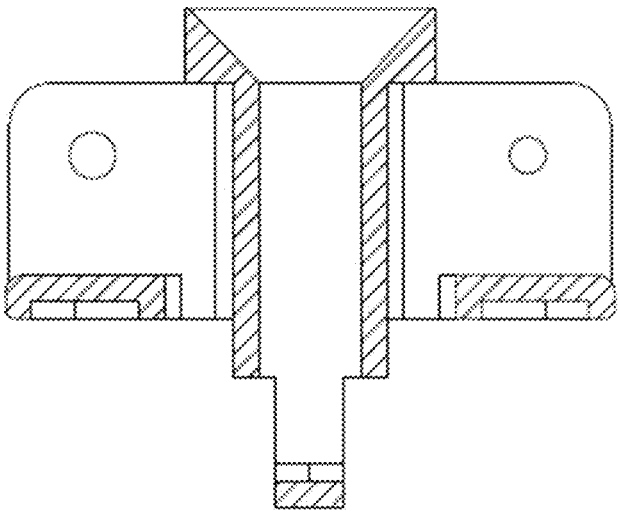
FIG. 7 is a section view of a surface A-A in FIG. 6.
Figure 8:
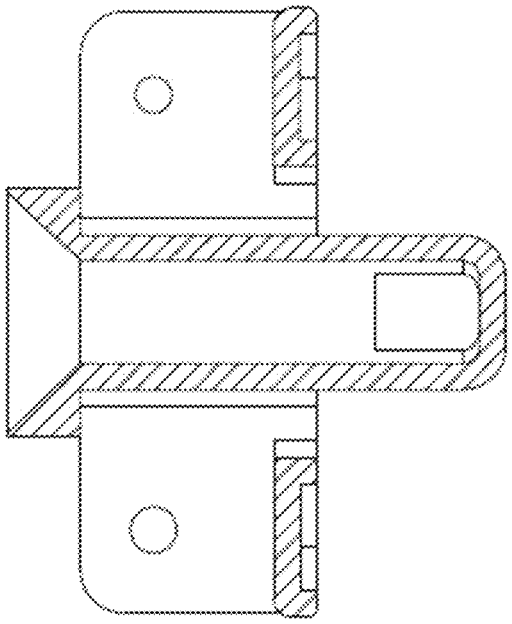
FIG. 8 is a section view of a surface C-C in FIG. 6.
Figure 9:
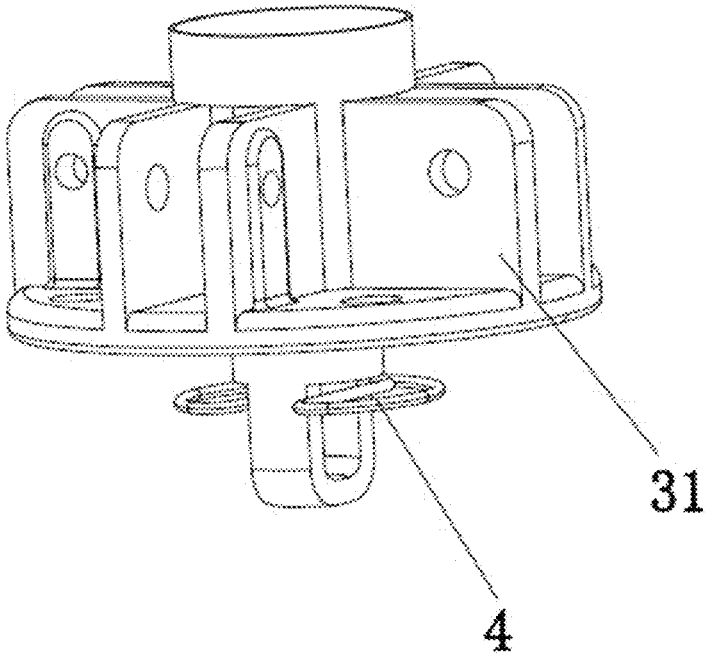
FIG. 9 is a schematic diagram of an assembly structure of a first lower plate and an elastic locking member.
Figure 10:
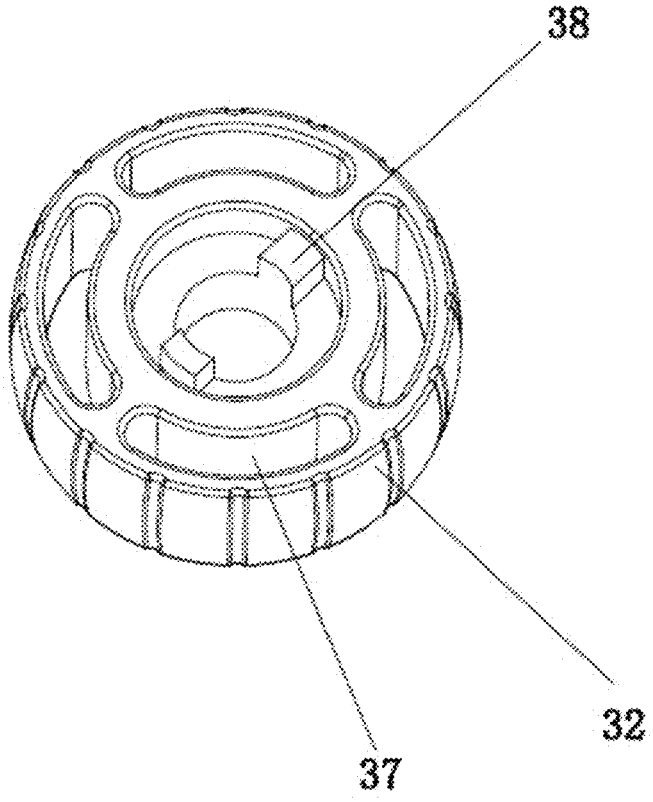
FIG. 10 is a schematic structural diagram of an unlocking plate according to the present invention.
Figure 11:
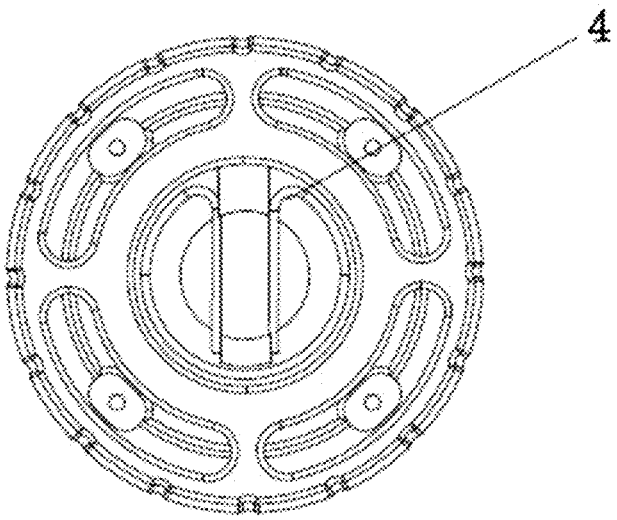
FIG. 11 is a schematic diagram of an assembly structure of the unlocking plate and the elastic locking member.
Figure 12:
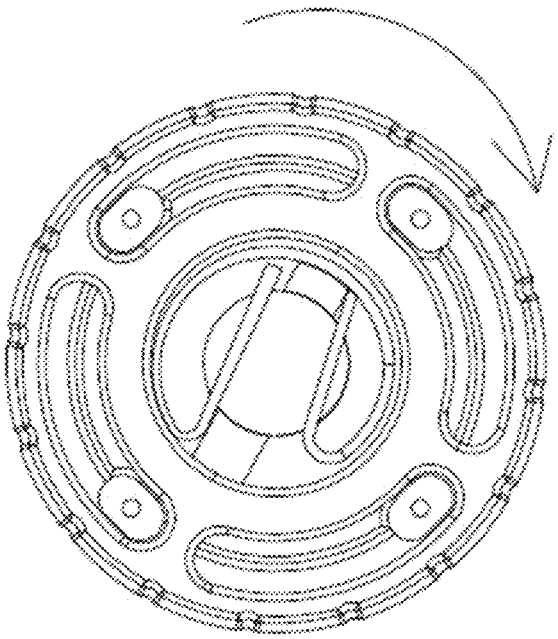
FIG. 12 is a schematic structural diagram of the unlocking plate that clockwise rotates.

In the present invention, when unlocking is performed, the unlocking plate 32 only needs to be screwed clockwise or counterclockwise. For two opposite sides of two ends of each of the locking rods 42 of the elastic locking member 4, one of the opposite sides abuts on each corresponding locking block 38 in an inclined manner, and the other opposite side is inclined away from the corresponding locking block 38, as shown in FIG. 12 to FIG. 13, so that a distance between the two locking rods 42 becomes larger, the clamping and locking portion 12 is detached between the two locking rods 42, and the locking rods 42 are detached from the elastic locking member 4, thereby implementing unlocking.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A central bidirectional rotation locking mechanism for a folding tent, the central bidirectional rotation locking mechanism comprising a lock rod, an upper lock plate fixedly disposed at an upper end of the lock rod, and a lower lock plate assembly detachably connected to a lower end of the lock rod, wherein the lower lock plate assembly comprises a first lower plate, an unlocking plate and a second lower plate, an elastic locking member and an unlocking mechanism used to control the elastic locking member to perform locking are disposed in the unlocking plate, the elastic locking member is used to lock the lock rod, and the unlocking plate is capable of bidirectional rotation; when the unlocking plate rotates, the unlocking mechanism is enabled to unlock the elastic locking member and the lock rod, wherein a connection column is vertically disposed on an edge of the second lower plate, an arc-shaped travel hole that penetrates up and down is provided at a corresponding location on an edge of the unlocking plate, and after the connection column extends through the travel hole, the connection column is fixedly connected to the first lower plate by a fastening member.

2. The central bidirectional rotation locking mechanism for the folding tent according to claim 1, wherein a central hole through which the lock rod extends is correspondingly provided at a central location of the first lower plate and a central location of the unlocking plate, a locking column extending downwards is disposed at a location, corresponding to the central hole, of a lower surface of the first lower plate, and a locking space is provided on the locking column.

3. The central bidirectional rotation locking mechanism for the folding tent according to claim 2, wherein the upper lock plate is hingedly connected to a long tent bone, the first lower plate is hingedly connected to a short tent bone, the locking space is two cutting faces that are symmetrically provided on the locking column, two horizontal locking rods are clamped on the two cutting faces, and a distance between the two cutting faces is less than an aperture of the central hole.

4. The central bidirectional rotation locking mechanism for the folding tent according to claim 1, wherein the elastic locking member comprises an integrally disposed arc-shaped portion and two horizontal locking rods extending inwards from a gap of the arc-shaped portion, a lower end portion of the lock rod is provided with a step used in cooperation with the locking rods, and the step extends downwards to form a clamping and locking portion of an arc-shaped structure.

5. The central bidirectional rotation locking mechanism for the folding tent according to claim 4, wherein the unlocking mechanism comprises locking blocks that are symmetrically disposed on an inner wall of the unlocking plate, a gap is reserved between each of the locking blocks and the inner wall of the unlocking plate, the gap is used to place a closed end of the arc-shaped portion of the elastic locking member, and two ends of each of the locking rods of the elastic locking member respectively abut on two sides of the corresponding locking block.

6. The central bidirectional rotation locking mechanism for the folding tent according to claim 5, wherein a width between two locking rods is not less than a width between the locking blocks.

7. The central bidirectional rotation locking mechanism for the folding tent according to claim 1, wherein a plurality of the connection columns are disposed along the edge of the second lower plate through uniform distribution, and a quantity of the travel holes is the same as a quantity of the connection columns.

8. The central bidirectional rotation locking mechanism for the folding tent according to claim 1, wherein a radian of the travel hole is the same as a radian of the unlocking plate.

* * * * *